US010007201B2

(12) United States Patent
Washino

(10) Patent No.: US 10,007,201 B2
(45) Date of Patent: Jun. 26, 2018

(54) ELECTROSTATIC LATENT IMAGE DEVELOPING TONER

(71) Applicant: KYOCERA Document Solutions Inc., Osaka (JP)

(72) Inventor: Yusuke Washino, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/435,455

(22) Filed: Feb. 17, 2017

(65) Prior Publication Data

US 2017/0242359 A1 Aug. 24, 2017

(30) Foreign Application Priority Data

Feb. 23, 2016 (JP) ..... 2016-032033

(51) Int. Cl.
*G03G 9/087* (2006.01)
*G03G 9/093* (2006.01)
*G03G 9/09* (2006.01)

(52) U.S. Cl.
CPC ..... *G03G 9/09321* (2013.01); *G03G 9/0918* (2013.01); *G03G 9/09371* (2013.01); *G03G 9/09392* (2013.01)

(58) Field of Classification Search
CPC ..... G03G 9/08708; G03G 9/08768; G03G 9/08764; G03G 9/1135
See application file for complete search history.

(56) References Cited

U.S. PATENT DOCUMENTS 8,394,565 B2 3/2013 Sensui
2010/0173240 A1 7/2010 Sensui

FOREIGN PATENT DOCUMENTS

WO 2007/114502 A1 10/2007

*Primary Examiner* — Peter L Vajda
(74) *Attorney, Agent, or Firm* — Studebaker & Brackett PC

(57) ABSTRACT

An electrostatic latent image developing toner includes a plurality of toner particles each including a core and a shell layer covering a surface of the core. The shell layer includes a resin film and a plurality of resin particles. The shell layer contains a first resin forming the resin film, a second resin forming the resin particles, and an alkyl benzene sulfonic acid compound. The first resin is more hydrophobic than the second resin. The second resin is more positively chargeable than the first resin. The second resin has a repeating unit capable of forming a salt with the alkyl benzene sulfonic acid compound.

9 Claims, 3 Drawing Sheets

ELECTROSTATIC LATENT IMAGE DEVELOPING TONER

INCORPORATION BY REFERENCE

The present application claims priority under 35 U.S.C. § 119 to Japanese Patent Application No. 2016-032033, filed on Feb. 23, 2016. The contents of this application are incorporated herein by reference in their entirety.

BACKGROUND

The present disclosure relates to an electrostatic latent image developing toner, and in particular relates to a capsule toner.

Toner particles included in the capsule toner each include a core and a shell layer (capsule layer) disposed over the surface of the core. The shell layer in an example of the capsule toner is a layer of aggregated and fusion-bonded particulates of a resin having a repeating unit derived from a quaternary ammonium compound.

SUMMARY

An electrostatic latent image developing toner according to the present disclosure includes a plurality of toner particles each including a core and a shell layer covering a surface of the core. The shell layer includes a resin film and a plurality of resin particles. The shell layer contains a first resin forming the resin film, a second resin forming the resin particles, and an alkyl benzene sulfonic acid compound. The first resin is more hydrophobic than the second resin. The second resin is more positively chargeable than the first resin. The second resin has a repeating unit capable of forming a salt with the alkyl benzene sulfonic acid compound.

DETAILED DESCRIPTION

Figure 1:
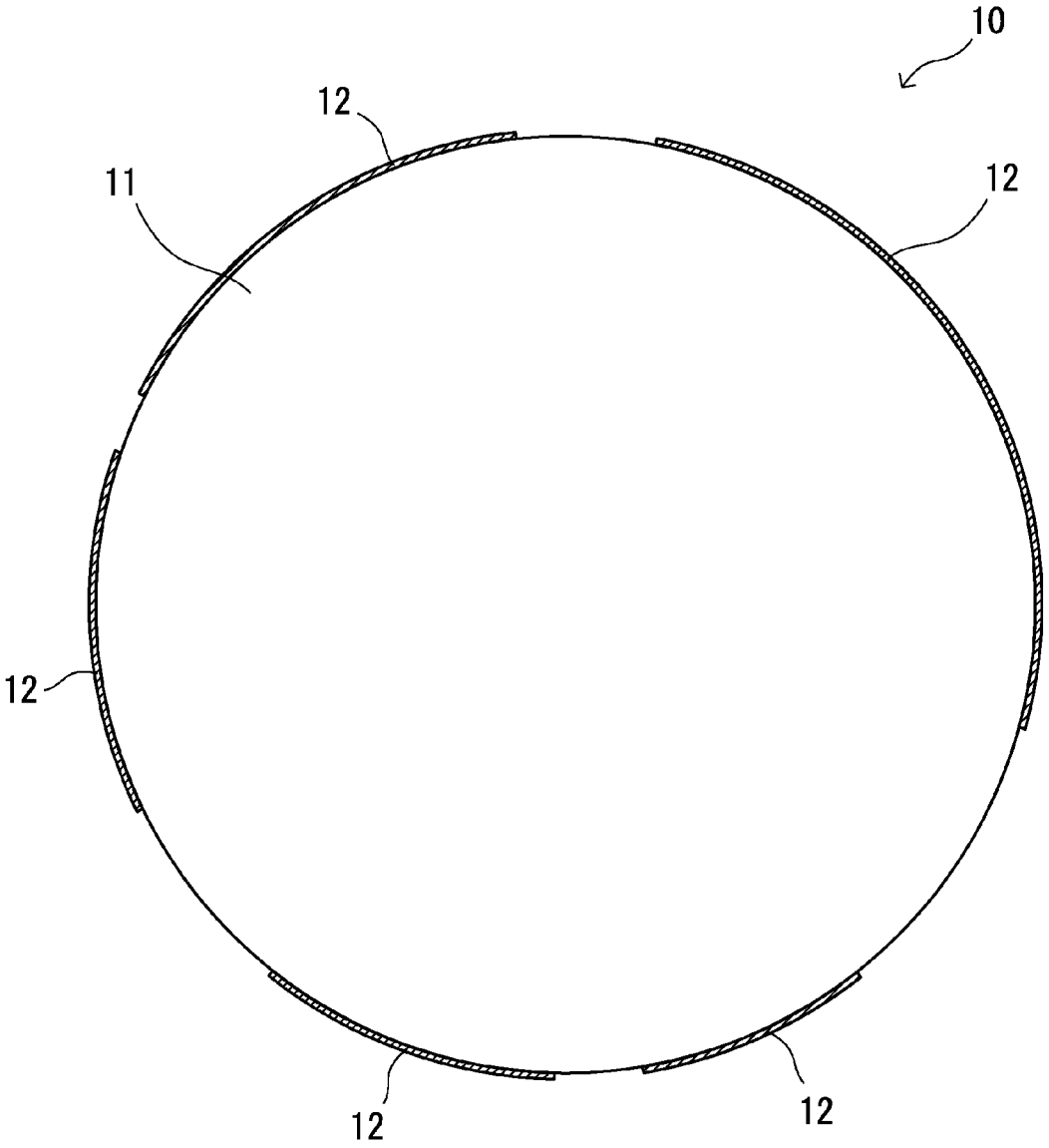
FIG. 1 is a cross sectional view illustrating an example of a toner particle (specifically, a toner mother particle) included in an electrostatic latent image developing toner according to an embodiment of the present disclosure.

Hereinafter, an embodiment of the present disclosure will be described in detail. Note that evaluation results (values indicating shape, physical properties, or the like) for a powder (more specifically, toner cores, toner mother particles, an external additive, or a toner) are number average values measured with respect to an appropriate number of particles of the powder unless otherwise stated.

A number average particle size of a powder is a number average value of equivalent circular diameters of primary particles (diameters of circles having the same areas as projected areas of the respective particles) measured using a microscope unless otherwise stated. A measured value of a volume median diameter ($D_{50}$) of a powder is a value measured using a laser diffraction/scattering particle size distribution analyzer (LA-750 produced by Horiba, Ltd.) unless otherwise stated.

A measured value of a glass transition point (Tg) is a value measured using a differential scanning calorimeter (DSC-6220 produced by Seiko Instruments Inc.) unless otherwise stated. A measured value of a softening point (Tm) is a value measured using a capillary rheometer (CFT-500D produced by Shimadzu Corporation) unless otherwise stated. Measured values of an acid value and a hydroxyl value are values measured in accordance with Japan Industrial Standard (Jis) K0070-1992 unless otherwise stated. Measured values of a number average molecular weight (Mn) and a mass average molecular weight (Mw) are values measured by gel permeation chromatography unless otherwise stated.

Charge strength corresponds to susceptibility to frictional charging unless otherwise stated. For example, when a toner is mixed with a standard carrier (anionic strength: N-01, cationic strength: P-01) provided by The Imaging Society of Japan and stirred, the toner can be frictionally charged. In a situation in which the surface potential of toner particles is measured using for example a Kelvin probe force microscopy (KFM) before and after being frictionally charged, a part of the toner particles where potential variation between before and after being frictionally charged is large is strongly charged.

Hydrophobic strength (or hydrophilic strength) can be indicated by for example a contact angle of a water droplet (water wettability). A larger contact angle of a water droplet indicates stronger hydrophobicity.

In the present description, the term "-based" may be appended to the name of a chemical compound in order to form a generic name encompassing both the chemical compound itself and derivatives thereof. When the term "-based" is appended to the name of a chemical compound used in the name of a polymer, the term in indicates that a repeating unit of the polymer originates from the chemical compound or a derivative thereof. In the present description, the term "(meth)acryl" is used as a generic term for both acryl and methacryl. Also, the term "(meth)acryloyl" is used as a generic term for both acryloyl ($CH_2{=}CH{-}CO{-}$) and methacryloyl ($CH_2{=}C(CH_3){-}CO{-}$). A subscript "n" representing a repeating unit in a chemical formula indicates the number of repetitions (the number of moles) of the repeating unit independently of one another. Unless otherwise stated, n (number of repetitions) is arbitrary.

A toner according to the present embodiment can be suitably used for example as a positively chargeable toner for development of an electrostatic latent image. The toner according to the present embodiment is a powder including a plurality of toner particles (particles each having features described later). The toner may be used as a one-component developer. Alternatively, the toner may be mixed with a carrier using a mixer (for example, a ball mill) to prepare a two-component developer. In order to form a high-quality image, a ferrite carrier (a powder of ferrite particles) is preferably used as the carrier. In order to form a high-quality image over a long period of time, magnetic carrier particles each including a carrier core and a resin layer covering the carrier core are preferably used. Carrier cores may be formed from a magnetic material (for example, a ferromagnetic material such as ferrite) or a resin in which magnetic particles are dispersed in order to impart magnetism to carrier particles. Alternatively, the magnetic particles may be dispersed in the resin layers covering the carrier cores. In order to form a high-quality image, the amount of the toner in the two-component developer is preferably at least 5 parts by mass and no greater than 15 parts by mass relative to 100 parts by mass of the carrier. Note that a positively chargeable toner included in a two-component developer is positively charged by friction with a carrier.

The toner particles included in the toner according to the present embodiment each include a core (hereinafter referred to as a toner core) and a shell layer (a capsule layer) covering the surface of the toner core. Both high-temperature preservability and low-temperature fixability of the toner can be attained by covering the toner core that melts at a low temperature by the shell layer that has excellent heat resistance. An external additive may be caused to adhere to the surface of the shell layer (or a surface region of the toner core not covered by the shell layer). Note that the external additive may be omitted in a situation in which such an additive is not necessary. In the present description, the toner particles prior to adhesion of an external additive thereto are referred to as toner mother particles. A material used for forming the toner cores is referred to as a toner core material. A material used for forming the shell layers is referred to as a shell material.

The toner according to the present embodiment can be used for example in an electrophotographic apparatus (an image forming apparatus) for image formation. The following describes an example of an image forming method using an electrophotographic apparatus.

First, an image forming section (a charger and an exposure device) of the electrophotographic apparatus forms an electrostatic latent image on a photosensitive member based on image data. Subsequently, a developing device of the electrophotographic apparatus (specifically, a developing device loaded with a developer including the toner) supplies the toner onto the photosensitive member to develop the electrostatic latent image formed on the photosensitive member. The toner is charged by friction with a carrier in the developing device, a development sleeve, or a blade before being supplied onto the photosensitive member. For example, a positively chargeable toner is positively charged. In a development process, the toner (specifically, the charged toner) on the development sleeve (for example, a surface layer portion of a development roller in the developing device) disposed in the vicinity of the photosensitive member is supplied onto the photosensitive member and attached to the electrostatic latent image to form a toner image on the photosensitive member. The toner consumed for the formation of the toner image is replenished to the developing device from a toner container storing the toner for replenishment use.

In a subsequent transfer process, a transfer device of the electrophotographic apparatus transfers the toner image on the photosensitive member to an intermediate transfer member (for example, a transfer belt), and further transfers the toner image on the intermediate transfer member to a recording medium (for example, paper). Thereafter, a fixing device of the electrophotographic apparatus (fixing method: nip fixing using a heating roller and a pressure roller) applies heat and pressure to the toner to fix the toner to the recording medium. Through the above, an image is formed on the recording medium. A full-color image can be formed by for example superimposing toner images in four different colors: black, yellow, magenta, and cyan.

The toner according to the present embodiment is an electrostatic latent image developing toner having features described below (hereinafter referred to as basic features).

(Basic Features of Toner)

The electrostatic latent image developing toner includes a plurality of toner particles each including a toner core and a shell layer. The shell layer includes a resin film and a plurality of resin particles. The shell layer contains a first resin that foil is the resin film, a second resin that forms the resin particles, and an alkyl benzene sulfonic acid compound. The first resin is more hydrophobic than the second resin. The second resin is more positively chargeable than the first resin. The second resin has a repeating unit capable of forming a salt with the alkyl benzene sulfonic acid compound (hereinafter referred to as a specific repeating unit).

Note that the resin film included in the shell layer may be a film with no granular appearance, or a film with granular appearance. In a situation in which resin particles are used as a material for forming the resin film, if the material (resin particles) has been completely dissolved before curing in the form of a film, the resultant resin film is probably formed as a film with no granular appearance. By contrast, if the material (resin particles) has not been completely dissolved before curing in the form a film, the resultant resin film is probably formed as a film in which the resin particles are two-dimensionally arranged (namely, a film with granular appearance). The resin particles included in the shell layer may have a spherical shape or an oval shape (or a flat shape). All part of the shell layer is not necessarily formed integrally. The resin film included in the shell layer may be a single film or an aggregate of a plurality of film fragments (islands) separate from one another.

The toner having the above-described basic features is considered to be sufficiently positively chargeable in both an environment of normal temperature and normal humidity and an environment of high temperature and high humidity. Further, the toner having the above-described basic features is considered to enable formation of a high-quality image (for example, an image having low fogging density) in both an environment of normal temperature and normal humidity and an environment of high temperature and high humidity. Specifically, the toner having the above-described basic features is sufficiently positively chargeable through inclusion of the plurality of positively chargeable resin particles in the shell layers. Further, the shell layers in the toner having the above-described basic features include the resin film that is more hydrophobic than the resin particles. Therefore, adsorption of water molecules to the surfaces of the toner particles can be prevented in an environment of high temperature and high humidity. In a situation in which the surfaces of the toner particles hardly adsorb water molecules, decrease in positive charge amount of the toner particles is considered to be inhibited in an environment of high temperature and high humidity. Further, it is easy to ensure sufficient positive chargeability of the toner even after the toner was left in an environment of high temperature and high humidity for a long period of time. Use of a sufficiently positively chargeable toner enables formation of a high-quality image (for example, an image having low fogging density). Further, in a configuration in which the resin film covers a relatively large area of the surface region of the toner core, it is easy to ensure sufficient high-temperature preservability and external additive retentivity of the toner.

The shell layers in the toner having the above-described basic features contain the alkyl benzene sulfonic acid compound. Further, the second resin forming the resin particles in the shell layers has the specific repeating unit (repeating unit capable of forming a salt with the alkyl benzene sulfonic acid compound). The specific repeating unit is capable of forming a counter ion of an ion of the alkyl benzene sulfonic acid compound. In a configuration in which the second resin forming the resin particles in the shell layers has the specific repeating unit, the alkyl benzene sulfonic acid compound can be readily retained in the shell layers. The inventor found that in a configuration in which the shell layers retain an appropriate amount of the alkyl benzene sulfonic acid compound, it is possible to improve both a charge decay characteristic and a charge rise characteristic of the toner. In a configuration in which the alkyl benzene sulfonic acid compound and the specific repeating unit are present in the shell layers, charge mobility in the resin particles is considered to be improved. Through the above-described basic features, the charge decay characteristic and the charge rise characteristic of the toner can be improved without functionality enhancement by special design of a polymer.

The alkyl benzene sulfonic acid compound is less likely to be separated from the shell layers as a result of formation of a salt by the specific repeating unit and the alkyl benzene sulfonic acid compound.

An example of the alkyl benzene sulfonic acid compound is p-toluenesulfonic acid. The specific repeating unit is preferably a repeating unit derived from a quaternary ammonium compound or a repeating unit derived from an electron-donating heteroaromatic compound. The above repeating units tend to have excellent positive chargeability and strong basicity (specifically, Brønsted basicity). Therefore, the above repeating units readily form a salt with the alkyl benzene sulfonic acid compound. An example of the repeating unit derived from a quaternary ammonium compound is a repeating unit derived from 2-(methacryloyloxy)ethyl trimethylammonium chloride represented by Formula (1) given below (1)

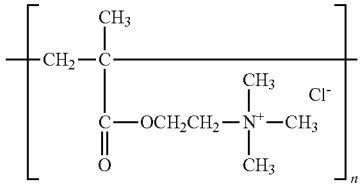

An example of the repeating unit derived from an electron-donating heteroaromatic compound is a repeating unit derived from 2-vinylpyridine. Through protonation of a pyridine moiety of the above repeating unit, a cation represented by. Formula (2) given below can be formed.

(2)

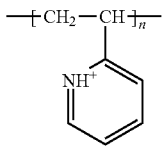

Through ionization of the p-toluenesulfonic acid, a p-toluenesulfonic acid ion (anion) represented by Formula (3) given below can be formed. In a situation in which the repeating unit derived from 2-(methacryloyloxy)ethyl trimethylammonium chloride forms a salt (forms an ionic bond) with the p-toluenesulfonic acid, the chloride ion (Cl_) in above Formula (1) is for example substituted with a p-toluenesulfonic acid ion (anion) represented by Formula (3) given below. In a situation in which the repeating unit derived from 2-vinylpyridine forms a salt (forms an ionic bond) with the p-toluenesulfonic acid, the p-toluenesulfonic acid ion (anion) represented by Formula (3) given below for example combines with the cation represented by above Formula (2).

(3)

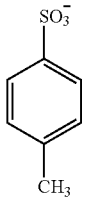

In order to improve the charge rise characteristic of the toner while preventing charge decay of the toner, the amount of the alkyl benzene sulfonic acid compound contained in the shell layers (hereinafter referred to as an ABS content) is preferably at least 50 ppm and no greater than 4000 ppm relative to a total mass of the toner. In a situation in which the ABS content is too small, the charge rise characteristic of the toner is insufficient and the toner is difficult to charge. In a situation in which the ABS content is too large, the toner is prone to charge decay. Note that an ABS content of 1 ppm means that 0.001 mg of the alkyl benzene sulfonic acid compound is contained in 1 g of the toner.

In order that the toner is sufficiently positively chargeable in both an environment of normal temperature and normal humidity and an environment of high temperature and high humidity, a rate of a total mass $M_B$ of the resin forming all the resin particles to a total mass $M_A$ of the resin forming all the resin films ($=100\times M_B/M_A$) is preferably at least 1% by mass and no greater than 20% by mass, and more preferably at least 5% by mass and no greater than 15% by mass.

In order that the toner is sufficiently positively chargeable in both an environment of normal temperature and normal humidity and an environment of high temperature and high humidity, it is more preferable that the toner having the above-described basic features further has features described below (hereinafter referred to as preferable shell features).

(Preferable Shell Features)

The surface of each shell layer has a sea-like region and a plurality of island-like regions distributed like islands in the sea-like region. The sea-like region is constituted by a portion of a resin film exposed at the surface of the shell layer. The island-like regions are constituted by portions of resin particles exposed from the resin film.

Figure 2:
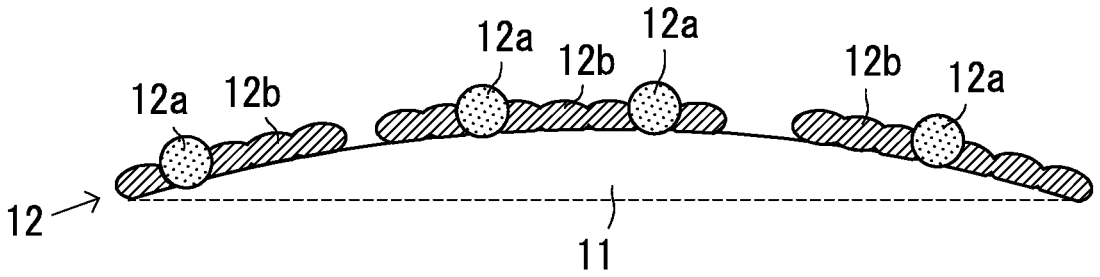
FIG. 2 is an enlarged view of a boundary portion between a toner core and a shell layer illustrated in FIG. 1.
Figure 3:
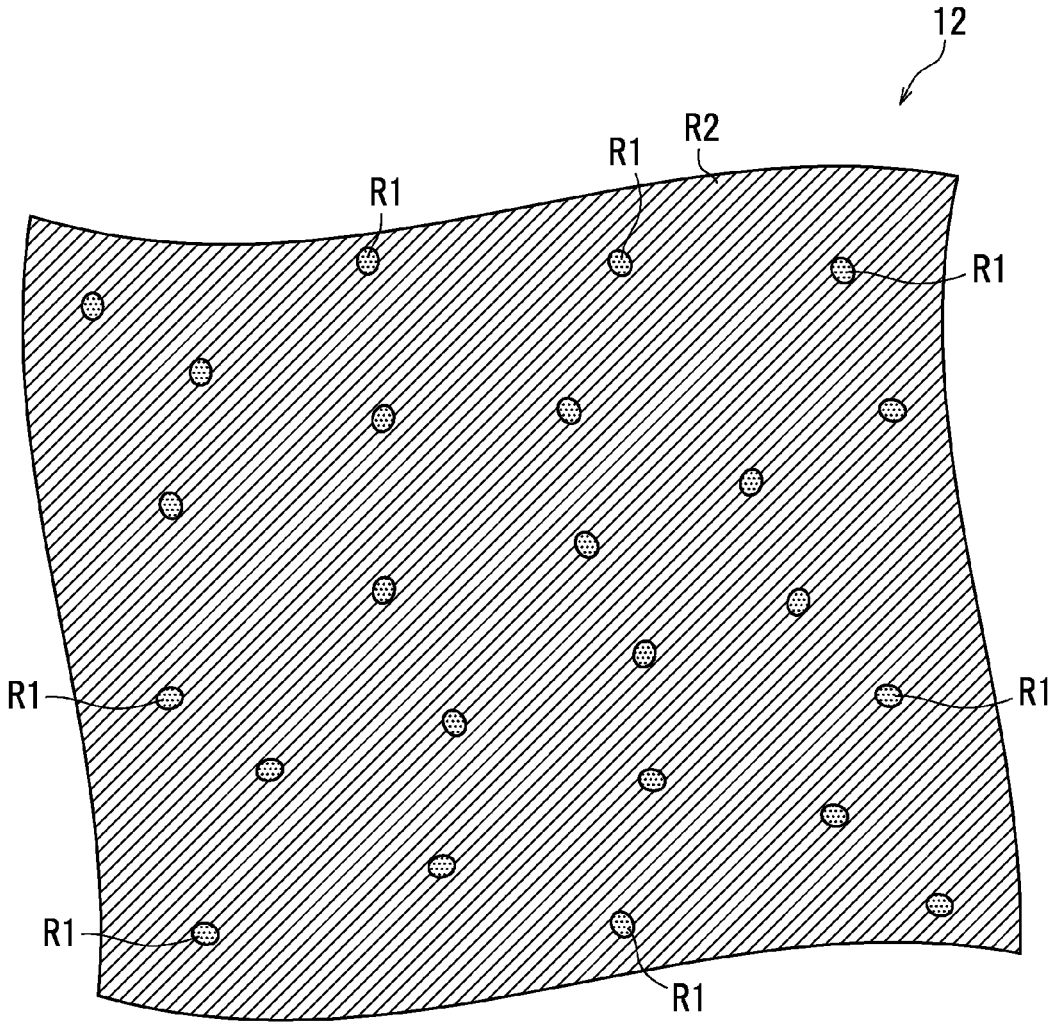
FIG. 3 is a view illustrating an example of the surface (plain structure) of the toner particle (specifically, the toner mother particle) illustrated in FIG. 1.

The following describes an example of a toner particle included in the toner having the above-described preferable shell features with reference to FIGS. 1-3. FIG. 1 is a cross sectional view illustrating an example of the toner particle (specifically, a toner mother particle) included in the toner having the above-described preferable shell features. FIG. 2 is an enlarged view of a boundary portion between a toner core and a shell layer illustrated in FIG. 1. FIG. 3 is a view illustrating an example of the surface (plain structure) of the toner particle (specifically, the toner mother particle) included in the toner having the above-described preferable shell features.

A toner mother particle 10 illustrated in FIG. 1 includes a toner core 11 and a shell layer 12 disposed over the surface of the toner core 11. The shell layer 12 partially covers the surface of the toner core 11.

The shell layer 12 includes a plurality of resin particles 12*a* and a resin film 12*b* as illustrated in FIG. 2. The plurality of resin particles 12*a* are each less hydrophobic (more hydrophilic) than the resin film 12*b* and more positively chargeable than the resin film 12*b*. The surface of the shell layer 12 has sea-and-island structure.

The surface of the shell layer 12 includes a plurality of island-like regions R1 (spot regions) and a sea-like region R2 (sheet region) as illustrated in FIG. 3. A portion of the resin film 12*b* illustrated in FIG. 2, which portion is exposed at the surface of the shell layer 12, constitutes the sea-like region R2. Portions of the resin particles 12*a* illustrated in FIG. 2, which portions are exposed from the resin film 12*b*, constitute the island-like regions R1. The plurality of island-like regions R1 are each positively chargeable. The sea-like region R2 is more hydrophobic than the island-like regions R1. Only one sea-like region R2 may be present. Alternatively, a plurality of sea-like regions R2 may be present. In the example illustrated in FIG. 3, the island-like regions R1 are distributed over the surface of the shell layer 12. The island-like regions R1 are each surrounded by the sea-like region R2.

In order that the toner is sufficiently positively chargeable in both an environment of normal temperature and normal humidity and an environment of high temperature and high humidity, it is preferable that the positively chargeable resin particles are surrounded by the hydrophobic resin film. In a configuration in which the resin film that is strongly hydrophobic surrounds the resin particles that are weakly hydrophobic (comparatively strongly hydrophilic), it is possible to effectively prevent adsorption of water molecules.

In order that the toner is sufficiently positively chargeable in both an environment of normal temperature and normal humidity and an environment of high temperature and high humidity, it is preferable that the positively chargeable resin particles are distributed over the surface of the shell layer. Distribution of positively chargeable regions without local collection can improve positive chargeability of the surfaces of the toner particles as a whole.

In order that the toner having the above-described preferable shell features is sufficiently positively chargeable in both an environment of normal temperature and normal humidity and an environment of high temperature and high humidity, a ratio ($=S_B/S_A$) of a total area $S_B$ of all the island-like regions relative to a total area $S_A$ of all the sea-like regions at the surfaces of the shell layers is preferably at least 0.01 and no greater than 0.20, and more preferably at least 0.05 and no greater than 0.15.

In order to ensure sufficient low-temperature fixability of the toner, the toner cores preferably contain a polyester resin having a glass transition point of at least 20° C. and no greater than 55° C. (hereinafter may be referred to as a low temperature-melting PES). In the following description, a glass transition point of the first resin (resin forming the resin films in the shell layers) may be referred to as "$Tg_A$". A glass transition point of the second resin (resin forming the resin particles in the shell layers) may be referred to as "$Tg_B$". A glass transition point of the low temperature-melting PES in the toner cores may be referred to as "$Tg_C$". $Tg_C$ is at least 20° C. and no greater than 55° C.

In order to obtain a toner having the above-described preferable shell features, it is preferable that $Tg_A$ is at least 60° C. and no greater than 75'C, $Tg_B$ is at least 80° C. and no greater than 110° C., $Tg_A$ is at least 10° C. higher than $Tg_C$ ($Tg_A \geq Tg_C + 10°$ C.), and $Tg_B$ is at least 10° C. higher than $Tg_A$ ($Tg_B \geq Tg_A + 10°$ C.). In a situation in which $Tg_A$, $Tg_B$, and $Tg_C$ satisfy the above, it is easy to form the first resin into a film while maintaining the second resin in its particulate form. Further, sufficient low-temperature fixability of the toner can be readily ensured while causing the resin particles to act as spacers between the toner particles.

In order to obtain a toner that is excellent in charge decay characteristic, charge rise characteristic, and low-temperature fixability, it is particularly preferable that, in the toner having the above-described preferable shell features, the first resin is a polymer of monomers (resin raw materials) including at least one styrene-based monomer and at least one acrylic acid-based monomer and the second resin is a polymer of monomers (resin raw materials) including at least one acrylic acid-based monomer and at least one monomer selected from the group consisting of pyridine compounds, pyridazine compounds, imidazole compounds, pyrazole compounds, and quaternary ammonium compounds.

The shell layers may contain a thermosetting resin in addition to the first resin and the second resin. In a configuration in which the shell layers contain a thermosetting resin (for example, a hydrophilic thermosetting resin) in addition to the resin film and the resin particles, it is possible to improve strength of the shell layers. In order to attain both charge stability and high-temperature preservability of the toner, it is preferable that the thermosetting resin constitutes at least 0.01% by mass and no greater than 10% by mass of resins contained in the shell layers.

In order that the toner is sufficiently positively chargeable in both an environment of normal temperature and normal humidity and an environment of high temperature and high humidity in a situation in which the toner has a volume median diameter ($D_{50}$) of at least 3 μm and less than 10 μm, preferably a half or more (more preferably at least 80% by number) of the resin particles in the shell layers (specifically, the resin particles described in the above description of the basic features) have an equivalent circular diameter of at least 20 nm and no greater than 50 nm.

In order to attain both high-temperature preservability and low-temperature fixability of the toner, the shell layer covers preferably at least 50% and no greater than 99%, and more preferably at least 70% and no greater than 95% of the entire surface area of each toner core.

Resins listed below can be preferably used as the toner core material and the shell material.

<Preferable Thermoplastic Resins>

Preferable examples of thermoplastic resins include styrene-based resins, acrylic acid-based resins (more specifically, polymers of acrylic acid esters and polymers of methacrylic acid esters), olefin-based resins (more specifically, polyethylene resins and polypropylene resins), vinyl chloride resins, polyvinyl alcohols, vinyl ether resins, N-vinyl resins, polyester resins, polyamide resins, and urethane resins. Also, a copolymer of any of these resins, that is, a copolymer of any of the resins into which an optional repeating unit is introduced (more specifically, styrene-acryl acid-based resins and styrene-butadiene-based resins) may be used.

A styrene-acrylic acid-based resin is a copolymer of at least one styrene-based monomer and at least one acrylic acid-based monomer. The below listed styrene-based monomers and acrylic acid-based monomers can be preferably used for synthesizing the styrene-acrylic acid-based resin. When an acrylic acid-based monomer having a carboxyl group is used, the carboxyl group can be introduced into the styrene-acrylic acid-based resin. Further, when a monomer having a hydroxyl group (specific examples include p-hydroxystyrene, m-hydroxystyrene, and (meth)acrylic acid hydroxyalkyl ester) is used, the hydroxyl group can be introduced into the styrene-acrylic acid-based resin. When the amount of the acrylic acid-based monomer is adjusted, the acid value of the resultant styrene-acrylic acid-based resin can be controlled. When the amount of the monomer having a hydroxyl group is adjusted, the hydroxyl value of the resultant styrene-acrylic acid-based resin can be controlled.

Preferable examples of styrene-based monomers include styrene, alkylstyrenes (specific examples include α-methylstyrene, o-methylstyrene, m-methylstyrene, p-methylstyrene, and p-ethylstyrene), hydroxystyrenes (specific examples include p-hydroxystyrene and m-hydroxystyrene), and halogenated styrenes (specific examples include α-chlorostyrene, o-chlorostyrene, m-chlorostyrene, and p-chlorostyrene).

Preferable examples of acrylic acid-based monomers include (meth)acrylic acid, (meth)acrylic acid alkyl esters, and (meth)acrylic acid hydroxyalkyl esters. Preferable examples of (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Preferable examples of (meth)acrylic acid hydroxyalkyl esters include 2-hydroxyethyl (meth)acrylate, 3-hydroxypropyl (meth)acrylate, 2-hydroxypropyl (meth)acrylate, and 4-hydroxybutyl (meth)acrylate.

A polyester resin can be obtained through condensation polymerization between at least one polyhydric alcohol and at least one polybasic carboxylic acid. Examples of alcohols that can be preferably used for synthesizing the polyester resin include dihydric alcohols (specific examples include aliphatic diols and bisphenols) and tri- or higher-hydric alcohols listed below. Examples of carboxylic acids that can be preferably used for synthesizing the polyester resin include di-basic or tri- or higher-basic carboxylic acids listed below. The acid value and the hydroxyl value of the polyester resin can be controlled by changing amounts of use of an alcohol and a carboxylic acid in synthesis of the polyester resin. An increase in the molecular weight of the polyester resin tends to result in a decrease in the acid value and the hydroxyl value of the polyester resin.

Preferable examples of aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Preferable examples of bisphenols include bisphenol A, hydrogenated bisphenol A, bisphenol A ethylene oxide adducts, and bisphenol A propylene oxide adducts.

Preferable examples of tri- or higher-hydric alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, digylcerol, 2-methylpropanethiol, 2-methyl-1,2,4-butanetriol, trimethylolethane, trimethylolpropane, and 1,3,5-trihydroxymethylbenzene.

Preferable examples of dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecyisuccinic acid), alkenyl succinic acids (specific examples include n-butenylsuccinic acid, isobutenylsuccinic acid, n-octenylsuccinic acid, n-dodecenylsuccinic acid, and isododecenylsuccinic acid), unsaturated dicarboxylic acids (specific examples include maleic acid, fumaric acid, citraconic acid, itaconic acid, and glutaconic acid), and cycloalkanedicarboxylic acids (specific examples include cyclohexanedicarboxylic acid).

Preferable examples of tri- or higher-basic carboxylic acids include 1,2,4-benzenetricarboxylic acid (nimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

<Preferable Thermosetting Resins>

Preferable examples of thermosetting resins include melamine-based resins, urea-based resins, sulfonamide-based resins, glyoxal-based resins, guanamine-based resins, aniline-based resins, polyimide resins (specific examples include maleimide polymers and bismaleimide polymers), and xylene-based resins.

Preferable examples of crosslinkable monomers that can be used for synthesizing a thermosetting resin include methylol melamine, melamine, methylol urea (specific examples include dimethylol dihydroxyethyleneurea), urea, benzoguanamine, acetoguanamine, and spiroguanamine.

The following describes the toner cores (a binder resin and internal additives), the shell layers, and the external additive in stated order. A component that is not necessary may be omitted according to the purpose of the toner.

[Toner Core]

Each toner core contains a binder resin. The toner core may optionally contain an internal additive (specific examples include a colorant, a releasing agent, a charge control agent, and a magnetic powder).

(Binder Resin)

The binder resin is typically a main component (constitutes for example at least 85% by mass) of the toner core. Properties of the binder resin are therefore expected to have great influence on an overall property of the toner core. Properties (more specifically, a hydroxyl value, an acid value, Tg, Tm, and the like) of the binder resin can be adjusted by using a combination of a plurality of resins as the binder resin. In a configuration in which the binder resin has an ester group, a hydroxyl group, an ether group, an acid group, or a methyl group, the toner core is highly likely to be anionic. In a configuration in which the binder resin has an amino group or an amide group, the toner core is highly likely to be cationic. In order to improve bondability (reactivity) between the toner core and the shell layer, at least one of the hydroxyl value and the acid value of the binder resin is preferably at least 10 mgKOH/g, and more preferably at least 20 mgKOH/g.

In order to improve fixability of the toner in high speed fixing, the binder resin preferably has a glass transition point (Tg) of at least 20° C. and no greater than 55° C. Also, in order to improve fixability of the toner in high speed fixing, the binder resin preferably has a softening point (Tm) of no greater than 105° C.

A thermoplastic resin (specific examples include those listed above in "Preferable Thermoplastic Resins") is preferably used as the binder resin of the toner core. In order to improve dispersibility of a colorant in the toner core, chargeability of the toner, and fixability of the toner to a recording medium, a styrene-acrylic acid-based resin or a polyester resin is particularly preferably used as the binder resin.

In order to improve strength of the toner core and fixability of the toner in a situation in which a styrene-acrylic acid-based resin is used as the binder resin of the toner core, the styrene-acrylic acid-based resin preferably has a number average molecular weight (Mn) of at least 2,000 and no greater than 3,000. The styrene-acrylic acid-based resin preferably has a molecular weight distribution (a ratio Mw/Mn of a mass average molecular weight (Mw) relative to a number average molecular weight (Mn)) of at least 10 and no greater than 20. Gel permeation chromatography can be employed for measuring Mn and Mw of the styrene-acrylic acid-based resin.

In order to improve strength of the toner core and fixability of the toner in a situation in which a polyester resin is used as the binder resin of the toner core, the polyester resin preferably has a number average molecular weight (Mn) of at least 1,000 and no greater than 2,000. The polyester resin preferably has a molecular weight distribution (a ratio Mw/Mn of a mass average molecular weight (Mw) relative to a number average molecular weight (Mn)) of at least 9 and no greater than 21. Gel permeation chromatography can be employed for measuring Mn and Mw of the polyester resin.

(Colorant)

The toner core may contain a colorant. The colorant can be a known pigment or dye that matches the color of the toner. The amount of the colorant is preferably at least 1 part by mass and no greater than 20 parts by mass relative to 100 parts by mass of the binder resin.

The toner core may contain a black colorant. An example of the black colorant is carbon black. The black colorant may be a colorant that is adjusted to a black color using a yellow colorant, a magenta colorant, and a cyan colorant.

The toner core may contain a non-black colorant such as a yellow colorant, a magenta colorant, or a cyan colorant.

One or more compounds selected from the group consisting of condensed azo compounds, isoindolinone compounds, anthraquinone compounds, azo metal complexes, methine compounds, and arylamide compounds can be used for example as the yellow colorant. Specific examples of preferable yellow colorants that can be used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow 5, Hansa Yellow G, and C.I. Vat Yellow.

One or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used for example as the magenta colorant. Specific examples of preferable magenta colorants that can be used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

One or more compounds selected from the group consisting of copper phthalocyanine compounds, anthraquinone compounds, and basic dye lake compounds can be used for example as the cyan colorant. Specific examples of preferable cyan colorants that can be used include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner core may contain a releasing agent. The releasing agent is for example used in order to improve fixability of the toner or resistance of the toner to being offset. In order to improve anionic strength of the toner core, the toner core is preferably prepared using an anionic wax. In order to improve fixability of the toner or resistance of the toner to being offset, the amount of the releasing agent is preferably at least 1 part by mass and no greater than 30 parts by mass relative to 100 parts by mass of the binder resin.

Preferable examples of releasing agents that can be used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a part or all of a fatty acid ester has been deoxidized such as deoxidized carnauba wax. One type of the releasing agents may be used, or a combination of plural types of the releasing agents may be used.

A compatibilizer may be added to the toner core in order to improve compatibility between the binder resin and the releasing agent.

(Charge Control Agent)

The toner core may contain a charge control agent. The charge control agent is for example used in order to improve charge stability or the charge rise characteristic of the toner. The charge rise characteristic of the toner is an indicator as to whether or not the toner can be charged to a specific charge level in a short period of time.

In a configuration in which the toner core contains a negatively chargeable charge control agent, it is possible to increase the anionic strength of the toner core. In a configuration in which the toner core contains a positively chargeable charge control agent, it is possible to increase the cationic strength of the toner core. However, if sufficient chargeability is ensured in the toner, there is no need to use a charge control agent.

(Magnetic Powder)

The toner core may contain a magnetic powder. Examples of materials of the magnetic powder that can be preferably used include ferromagnetic metals (specific examples include iron, cobalt, nickel, and an alloy containing one or more of the listed metals), ferromagnetic metal oxides (specific examples include ferrite, magnetite, and chromium dioxide), and materials subjected to ferromagnetization (specific examples include thermal treatment). One type of the magnetic powders may be used, or a combination of two or more types of the magnetic powders may be used. The magnetic powder is preferably subjected to surface treatment in order to inhibit elution of metal ions (for example, iron ions) from the magnetic powder.

[Shell Layer]

In the toner having the above-described basic features, each shell layer includes a resin film and a plurality of resin particles. Further, the shell layer contains the first resin forming the resin film, the second resin forming the resin particles, and the alkyl benzene sulfonic acid compound. In order to improve the charge decay characteristic and the charge rise characteristic of the toner, it is preferable that the shell layer contains p-toluenesulfonic acid or a derivative thereof as the alkyl benzene sulfonic acid compound.

The shell layer may optionally contain a thermosetting resin (specific examples include those listed above in "Preferable Thermosetting Resins") in addition to inclusion of the resin film, the resin particles, and the alkyl benzene sulfonic acid compound. In order to attain both charge stability and high-temperature preservability of the toner, the shell layer preferably contains at least one thermosetting resin selected from the group consisting of melamine-based resins, urea-based resins, and glyoxal-based resins.

(Resin Film)

In the above-described preferable shell features, the first resin forming the resin film is preferably a thermoplastic resin (specific examples are those listed above in "Preferable Thermoplastic Resins"), and particularly preferably a polymer of monomers (resin raw materials) including at least one styrene-based monomer (for example, styrene) and at least one acrylic acid-based monomer (for example, (meth)acrylic acid alkyl ester that has an alkyl group having a carbon number of at least 1 and no greater than 6). Styrene-acrylic acid-based resins tend to be more hydrophobic and more positively chargeable than polyester resins.

(Resin Particles)

In the above-described preferable shell features, the second resin forming the resin particles is preferably a thermoplastic resin (specific examples are those listed above in "Preferable Thermoplastic Resins") into which the specific repeating unit (repeating unit capable of forming a salt with the alkyl benzene sulfonic acid compound) is introduced. A quaternary ammonium compound or an electron-donating heteroaromatic compound is preferably used as a monomer for introducing the specific repeating unit into the second resin. The electron-donating heteroaromatic compound is preferably a nitrogen compound, and particularly preferably a pyridine compound.

A first preferable example of the second resin forming the resin particles is a polymer of monomers (resin raw materials) including at least one quaternary ammonium compound (for example, a quaternary ammonium salt) monomer and at least one acrylic acid-based monomer. It is particularly preferable that the at least one acrylic acid-based monomer of the first preferable example of the second resin includes at least one of methyl (meth)acrylate and ethyl (meth)acrylate. A second preferable example of the second resin forming the resin particles is a polymer of monomers (resin raw materials) including at least one electron-donating heteroaromatic compound (for example, vinylpyridine) monomer and at least one acrylic acid-based monomer. It is particularly preferable that the at least one acrylic acid-based monomer of the second preferable example of the second resin includes at least one of methyl (meth)acrylate and ethyl (meth)acrylate.

Preferable examples of monomers for introducing the specific repeating unit into the second resin (quaternary ammonium compounds and electron-donating heteroaromatic compounds) are listed below. Note that a derivative of any of the following compounds may be used as necessary.

Preferable examples of quaternary ammonium compounds include benzyldecylhexylmethyl ammonium salts, decyltrimethyl ammonium salts, (meth)acryloyl group-containing quaternary ammonium salts, vinyl group-containing quaternary ammonium salts, and poly(N-alkylethylenimine) derivatives. Examples of (meth)acryloyl group-containing quaternary ammonium salts include (meth)acrylamidoalkyltrimethylammonium salts (specific examples include (3-acrylamidepropyl)trimethyl ammonium chloride) and (meth)acryloyloxyalkyltrimethylammonium salts (specific examples include 2-(methacryloyloxy)ethyl trimethylammonium chloride. Preferable examples of electron-donating heteroaromatic compounds include pyridine compounds (specific examples include vinylpyridine), pyridazine compounds, imidazole compounds, and pyrazole compounds.

[External Additive]

As an external additive, inorganic particles may be caused to adhere to the surface of each toner mother particle. Unlike internal additives, the external additive is not present within the toner mother particle, but is selectively present on the surface of the toner mother particle (a surface layer portion of the toner particle). It is possible to cause external additive particles to adhere to the surface of each toner mother particle for example by stirring the toner mother particles (specifically, a powder including a plurality of toner mother particles) and the external additive (specifically, a powder including a plurality of external additive particles) together. The toner mother particle does not chemically react with the external additive particles. The external additive particles bond to the toner mother particle physically not chemically. Bonding strength between the toner mother particle and the external additive particles can be adjusted by controlling conditions of stirring (more specifically, a stirring time, a rotational speed for stirring, and the like) and particle size, shape, and surface conditions of the external additive particles. The amount of the external additive is preferably for example at least 0.5 part by mass and no greater than 10 parts by mass relative to 100 parts by mass of the toner mother particles. In order to improve fluidity or a handling property of the toner, the particle size of the external additive is preferably at least 0.01 μm and no greater than 1.0 μm.

Silica particles or particles of a metal oxide (specific examples include alumina, titanium oxide, magnesium oxide, zinc oxide, strontium titanate, and barium titanate) are preferably used as the external additive particles (inorganic particles). One type of the external additives may be used, or a combination of two or more types of the external additives may be used.

[Method for Producing Toner]

The following describes an example of a method for producing a toner having the above-described basic features. First, toner cores are prepared. Subsequently, the toner cores and shell materials (for example, a hydrophobic resin and a positively chargeable resin) are added to a liquid. Subsequently, the shell materials are caused to react in the liquid to form a shell layer substantially formed from the resins on the surface of each toner core. In order that the toner has the above-described basic features, it is preferable that the glass transition point ($Tg_B$) of the positively chargeable resin is at least 10° C. higher than the glass transition point ($Tg_A$) of the hydrophobic resin. In order that the shell layer contains an alkyl benzene sulfonic acid compound, it is preferable to form the shell layer on the surface of each toner core in a liquid containing the alkyl benzene sulfonic acid compound. When the shell layer is formed on the surface of each toner core in a liquid containing the alkyl benzene sulfonic acid compound, a salt can be readily formed by the alkyl benzene sulfonic acid compound and the specific repeating unit within the shell layer. Alternatively, the alkyl benzene sulfonic acid compound may be used for washing toner mother particles after preparation thereof in order that the shell layer (particularly, a surface layer portion of the shell layer) contains the alkyl benzene sulfonic acid compound.

In order to form a homogeneous shell layer, preferably a liquid containing the shell materials is for example stirred so that the shell materials are dissolved or dispersed in the liquid. In order to inhibit toner core components (particularly, a binder resin and a releasing agent) from being dissolved or eluted during formation of the shell layer, the shell layer is preferably formed in an aqueous medium. The aqueous medium is a medium containing water as a main component (specific examples include pure water and a mixed liquid of water and a polar medium). The aqueous medium may function as a solvent. A solute may be dissolved in the aqueous medium. The aqueous medium may function as a dispersion medium. A dispersoid may be dispersed in the aqueous medium. An alcohol (specific examples include methanol and ethanol) may for example be used as the polar medium in the aqueous medium. The boiling point of the aqueous medium is approximately 100° C.

The following describes the method for producing the toner by referring to a more specific example.

(Preparation of Toner Cores)

In order to easily obtain preferable toner cores, the toner cores are prepared preferably by an aggregation method or a pulverization method, and more preferably by the pulverization method. Generally, toner cores are broadly classified into pulverized cores (also called pulverized toners) and polymerized cores (also called chemical toners). Toner cores obtained by the pulverization method belong to the pulverized cores and toner cores obtained by the aggregation method belong to the polymerized cores. The toner cores of the toner having the above-described basic features are preferably pulverized cores containing a polyester resin.

The following describes an example of the pulverization method. First, a binder resin and an internal additive (for example, at least one of a colorant, a releasing agent, a charge control agent, and a magnetic powder) are mixed. The resultant mixture is then melt-kneaded. The resultant melt-kneaded product is pulverized and the resultant pulverized product is classified. Through the above, toner cores having a desired particle size are obtained.

The following describes an example of the aggregation method. First, a binder resin, a releasing agent, and a colorant each in the form of particulates are caused to aggregate in an aqueous medium to form aggregated particles containing components of the binder resin, the releasing agent, and the colorant. Subsequently, the resultant aggregated particles are heated to cause coalescence of the components contained in the aggregated particles. As a result, a dispersion of toner cores is obtained. Thereafter, unnecessary substances (a surfactant and the like) are removed from the dispersion of the toner cores to obtain the toner cores.

(Formation of Shell Layer)

A weakly acid aqueous medium (having a pH within a range for example from 3 to 5) is prepared by adding an acidic substance to ion exchanged water. It is possible to cause the shell layer contain an alkyl benzene sulfonic acid compound (for example, p-toluenesulfonic acid) by using the alkyl benzene sulfonic acid compound (for example, p-toluenesulfonic acid) as the acidic substance for pH adjustment.

Subsequently, the toner cores, a suspension of positively chargeable resin particles, and a suspension of hydrophobic resin particles are added to the aqueous medium after the pH adjustment. The positively chargeable resin particles contain a positively chargeable resin that has a repeating unit (specific repeating unit) capable of forming a salt with an alkyl benzene sulfonic acid compound in the shell layer (for example, an alkyl benzene sulfonic acid compound used for the above-described pH adjustment or a washing process described later). In order to introduce the specific repeating unit into a resin, a positively chargeable charge control agent (for example, a quaternary ammonium compound or an electron-donating heteroaromatic compound) is preferably used as a monomer for synthesizing the resin. The hydrophobic resin particles contain a hydrophobic resin (for example, a styrene-acrylic acid-based resin). In order that the surface of the shell layer has the sea-and-island structure described above (see FIG. 3), it is preferable that the positively chargeable resin has a certain level of strong hydrophilicity. Further, it is preferable to set amounts of the hydrophobic resin and the positively chargeable resin at an appropriate ratio. A material for synthesizing a thermosetting resin may be added to the liquid as necessary.

The shell materials (the positively chargeable resin particles and the hydrophobic resin particles) are attached to the surfaces of the toner cores in the liquid. In order to uniformly attach the shell materials to the surfaces of the toner cores, it is preferable that the toner cores are highly dispersed in the liquid containing the shell materials. In order to highly disperse the toner cores in the liquid, the liquid may contain a surfactant or be stirred using a stirring device having strong power (for example, Hivis Disper Mix produced by PRIMIX Corporation).

Subsequently, the temperature of the liquid containing the shell materials and the like is increased up to a predetermined retention temperature (for example, at least 50° C. and no greater than 85° C.) at a predetermined rate (for example, at least 0.1° C./min and no greater than 3° C./min) while the liquid is stirred. The temperature of the liquid is then maintained at the retention temperature for a predetermined time period (for example, at least 30 minutes and no greater than 4 hours) while the liquid is stirred. Bonding between the toner cores and the shell materials (solidification of the shell layers) is considered to proceed while the liquid is maintained at a high temperature (or increased in temperature). The positively chargeable resin in the particulate form is considered to be directly solidified in its particulate form on the surfaces of the toner cores. The hydrophobic resin in the particulate form is considered to be melted (or deformed) in the liquid and cured in the form of a film. The shell layer formed on the surface of each toner core includes a hydrophobic resin film (sea-like region) and positively chargeable resin particles (island-like regions) distributed like islands in the resin film (sea-like region). In a situation in which the liquid contains the alkyl benzene sulfonic acid compound, the specific repeating unit of the positively chargeable resin forming the resin particles is considered to form a salt with the alkyl benzene sulfonic acid compound. When the shell layer is formed on the surface of each toner core in the liquid, a dispersion in which toner mother particles are dispersed is prepared.

When the hydrophobic resin particles are attached to the surface of each toner core in the liquid and the liquid is heated as described above, it is possible to melt (deform) the hydrophobic resin particles to form a film. However, the hydrophobic resin particles may be formed into a film by being heated in a drying process or receiving physical impact force in an external addition process.

After formation of the shell layer as above, the dispersion of the toner mother particles is neutralized using for example sodium hydroxide. The dispersion of the toner mother particles is then cooled for example to normal temperature (approximately 25° C.). Subsequently, the dispersion of the toner mother particles is filtrated using for example a Buchner funnel. Through the above, the toner mother particles are separated (solid-liquid separated) from the liquid to collect a wet cake of the toner mother particles.

It is possible to cause the shell layer contain the alkyl benzene sulfonic acid compound (for example, p-toluenesulfonic acid) by washing the resultant wet cake of the toner mother particles using the alkyl benzene sulfonic acid compound (for example, p-toluenesulfonic acid).

The collected wet cake of the toner mother particles is then washed with water. Subsequently, the washed toner mother particles are dried. Thereafter, as necessary, the toner mother particles and an external additive may be mixed using a mixer (for example, an FM mixer produced by Nippon Coke & Engineering Co., Ltd.) to cause the external additive to adhere to the surface of each toner mother particle. In a situation in which a spray dryer is used in the drying process, the drying process and the external addition process can be carried out simultaneously by spraying a dispersion of an external additive (for example, silica particles) toward the toner mother particles. Through the above, a toner including a large number of toner particles is produced.

The contents and the order of the processes in the above-described method for producing the toner may be altered as appropriate in accordance with requirements of the toner, such as in terms of composition and properties. For example, the shell materials and the toner cores may be added altogether at one time or separately. The shell materials may be added to the liquid at one time or in plural times. For example, in a situation in which materials (for example, the shell materials) are caused to react in the liquid, the materials may be caused to react in the liquid for a specific time period after addition of the materials to the liquid. Alternatively, the materials may be caused to react in the liquid while being added to the liquid over a long period of time. The toner may be sifted after the external addition process. Note that non-essential processes may be omitted. For example, in a situation in which a commercially available product can be used directly as a material, use of the commercially available product can omit the process of preparing the material. In a situation in which reaction for forming the shell layer progresses favorably even without pH adjustment of the liquid, the process of pH adjustment may be omitted. In a configuration in which the external additive is not attached to the surfaces of the toner mother particles (i.e., a situation in which the external addition process is omitted), the toner mother particles and the toner particles are equivalent. A monomer or prepolymer may be used as a material for synthesizing a resin. In order to yield a specific compound, a salt, ester, hydrate, or anhydride of the compound may be used as a raw material. The respective materials may be used in a solid state or a liquid state. For example, a powdery material in a solid state may be used. Alternatively, a solution of a material (a material in a liquid state dissolved in a solvent) may be used or a dispersion of a material (a liquid in which an undissolved material is dispersed) may be used. Preferably, a large number of the toner particles are formed at the same time in order to produce the toner efficiently. The toner particles produced at the same time are considered to have substantially the same configuration.

Examples

The following describes examples of the present disclosure. Table 1 indicates toners T-1 to T-8 (electrostatic latent image developing toners) according to examples and comparative examples.

TABLE 1

| | Shell layer | | Alkyl benzene |
|---|---|---|---|
| Toner | Positively chargeable resin | Hydrophobic resin | sulfonic acid compound [ppm] |
| T-1 | B-1 | A | 50 |
| T-2 | B-1 | | 4000 |
| T-3 | B-3 | | 3500 |
| T-4 | B-4 | | 3800 |
| T-5 | B-1 | | 5000 |
| T-6 | B-2 | A | 10 |
| T-7 | B-5 | | 20 |
| T-8 | B-1 | | 0 |

The following describes methods for producing the toners T-1 to T-8 (electrostatic latent image developing toners) according to the examples and the comparative examples, evaluation methods, and evaluation results in stated order. In evaluations in which errors may occur, an evaluation value was calculated by calculating the arithmetic mean of an appropriate number of measured values in order to ensure that any errors were sufficiently small. A number average particle size of a powder was measured using a transmission electron microscope (TEM). Respective methods for measuring a glass transition point (Tg) and a softening point (Tm) were as follows unless otherwise stated.

<Method for Measuring Tg>

A heat absorption curve of a sample (for example, a resin) was plotted using a differential scanning calorimeter (DSC-6220 produced by Seiko Instruments Inc.). Then, the glass transition point (Tg) of the sample was read from the plotted heat absorption curve. The glass transition point (Tg) of the sample is a temperature on the plotted heat absorption curve corresponding to a point of variation of the specific heat (an intersection point of an extrapolated baseline and an extrapolated fall line).

<Method for Measuring Tm>

An S-shaped curve (horizontal axis: temperature, vertical axis: stroke) of a sample (for example, a resin) was plotted by placing the sample in a capillary rheometer (CFT-500D produced by Shimadzu Corporation) and causing melt-flow of 1 $cm^3$ of the sample under conditions of a die pore diameter of 1 mm, a plunger load of 20 $kg/cm^2$, and a heating rate of 6° C./min. Then, the softening point (Tm) of the sample was read from the plotted S-shaped curve. The softening point (Tm) of the sample is a temperature on the plotted S-shaped curve corresponding to a stroke value of "$(S_1+S_2)/2$", where $S_1$ represents a maximum stroke value and $S_2$ represents a baseline stroke value at low temperatures.

[Preparation of Toner Cores]

A polyester resin (a binder resin) was synthesized by causing a reaction between a bisphenol A ethylene oxide adduct (specifically, an alcohol produced through addition of ethylene oxide to a bisphenol A framework) and a polyfunctional acid (specifically, terephthalic acid). The resultant polyester resin had an acid value (AV) of 10 mgKOH/g, a hydroxyl value (OHV) of 20 mgKOH/g, a softening point (Tm) of 100° C., and a glass transition point (Tg) of 48° C.

An FM mixer (produced by Nippon Coke & Engineering Co., Ltd.) was used to mix 100 parts by mass of the binder resin (the polyester resin obtained as above), 5 parts by mass of a releasing agent (an ester wax having a melting point of 73° C.: NISSAN ELECTOL (registered Japanese trademark) WEP-3 produced by NOF Corporation), and 5 parts by mass of a colorant (CI. Pigment Blue 15:3, component: copper phthalocyanine pigment).

Subsequently, the resultant mixture was melt-kneaded using a two-screw extruder (PCM-30 produced by Ikegai Corp.) The resultant melt-kneaded product was then cooled. The cooled melt-kneaded product was then pulverized using Turbo Mill (produced by FREUND-TURBO CORPORATION). The resultant pulverized product was then classified using a classifier (Elbow Jet EJ-LABO produced by Nittetsu Mining Co., Ltd.). Through the above, toner cores having a volume median diameter ($D_{50}$) of 6 μm were obtained.

[Preparation of Shell Materials]

(Preparation of Suspension A)

A 1-L three-necked flask equipped with a thermometer and a stirring impeller was set in a water bath. Then, the flask was charged with 875 g of ion exchanged water at 30° C. and 75 g of an anionic surfactant (LATEMUL (registered Japanese trademark) produced by Kao Corporation, component: polyoxyethylene alkyl ether sodium sulfate, solid concentration: 26% by mass). Then, the internal temperature of the flask was increased to 80° C. using the water bath and then maintained at the temperature (80° C.). Subsequently, two liquids (a first liquid and a second liquid) were added dropwise over five hours each to the flask contents at a temperature of 80° C. The first liquid was a mixed liquid of 17 g of styrene and 3 g of butyl acrylate. The second liquid was a solution of 0.5 g of potassium peroxodisulfate dissolved in 30 g of ion exchanged water. The internal temperature of the flask was then maintained at 80° C. for additional two hours for polymerization of the flask contents. As a result, a suspension A of hydrophobic resin particles (solid concentration: 15% by mass) was prepared. The resin particles contained in the prepared suspension A had a number average particle size of 32 nm and a glass transition point (Tg) of 71° C.

(Preparation of Suspension B-1)

A 1-L three-necked flask equipped with a thermometer, a cooling tube, a nitrogen inlet tube, and a stirring impeller was charged with 90 g of isobutanol, 105 g of methyl methacrylate, 37 g of butyl acrylate, 30 g of 2-(methacryloyloxy)ethyl trimethylammonium chloride (product of Alfa Aesar), and 6 g of 2,2'-azobis(2-methyl-N-(2-hydroxyethyl) propionamide) (VA-086 produced by Wako Pure Chemical industries, Ltd.). Subsequently, the flask contents were caused to react for three hours in a nitrogen atmosphere at a temperature of 80° C. Thereafter, 3 g of 2,2'-azobis(2-methyl-N-(2-hydroxyethyl)propionamide) (VA-086 produced by Wako Pure Chemical industries, Ltd.) was added to the flask contents to cause reaction of the flask contents for additional three hours in a nitrogen atmosphere at a temperature of 80° C., thereby obtaining a liquid containing a polymer. The obtained liquid containing the polymer was subsequently dried in a reduced-pressure atmosphere at a temperature of 150° C. The resultant dried polymer was then broke up, thereby yielding a positively chargeable resin.

Subsequently, a vessel of a mixer (HIVIS MIX (registered Japanese trademark) Model 2P-1 produced by PRIMIX Corporation) was charged with 200 g of the positively chargeable resin yielded as above and 184 g of ethyl acetate (ethyl acetate JIS special grade produced by Wako Pure Chemical Industries, Ltd.). The vessel contents were then stirred using the mixer at a rotational speed of 20 rpm for one hour to prepare a high-viscosity solution. Thereafter, an aqueous solution of ethyl acetate and the like (specifically, an aqueous solution of 18 g of 1N-hydrochloric acid, 20 g of an anionic surfactant (Emal (registered Japanese trademark) 0 produced by Kao Corporation, component: sodium lauryl sulfate), and 16 g of ethyl acetate (ethyl acetate JIS special grade produced by Wako Pure Chemical Industries, Ltd.) dissolved in 562 g of ion exchanged water) was added to the yielded high-viscosity solution. As a result, a suspension B-1 of positively chargeable resin particles (resin particles containing a charge control agent) (solid concentration: 8.1% by mass) was prepared. The resin particles contained in the yielded suspension B-1 had a number average particle size of 35 nm and a glass transition point (Tg) of 90° C.

(Preparation of Suspension B-2)

A suspension B-2 was prepared according to the same method as the suspension B-1 in all aspects other than that 6 g of 2-vinylthiophene (product of Alfa Chemistry) was used instead of 30 g of 2-(methacryloyloxy)ethyl trimethylammonium chloride (product of Alfa Aesar) and the amount of butyl acrylate was changed from 37 g to 10 g. The resin particles contained in the yielded suspension B-2 (solid concentration: 8.4% by mass) had a number average particle size of 30 nm and a glass transition point (Tg) of 84° C.

(Preparation of Suspension B-3)

A suspension B-3 was prepared according to the same method as the suspension B-1 in all aspects other than that 10 g of 2-vinylpyridine (product of Sigma-Aldrich) was used instead of 30 g of 2-(methacryloyloxy)ethyl trimethylammonium chloride (product of Alfa. Aesar) and the amount of butyl acrylate was changed from 37 g to 10 g. The resin particles contained in the yielded suspension B-3 (solid concentration: 8.2% by mass) had a number average particle size of 30 nm and a glass transition point (Tg) of 84° C.

(Preparation of Suspension B-4)

A suspension B-4 was prepared according to the same method as the suspension B-1 in all aspects other than that 10 g of 4-vinylpyridine (product of Sigma-Aldrich) was used instead of 30 g of 2-(methacryloyloxy)ethyl trimethylammonium chloride (product of Alfa Aesar) and the amount of butyl acrylate was changed from 37 g to 10 g. The resin particles contained in the yielded suspension B-4 (solid concentration: 8.2% by mass) had a number average particle size of 30 nm and a glass transition point (Tg) of 90° C.

(Preparation of Suspension B-5)

A suspension B-5 was prepared according to the same method as the suspension B-1 in all aspects other than that 28 g of 9-vinylcarbazole (product of Sigma-Aldrich) was used instead of 30 g of 2-(methacryloyloxy)ethyl trimethylammonium chloride (product of Alfa Aesar) and the amount of butyl acrylate was changed from 37 g to 10 g. The resin particles contained in the yielded suspension B-5 (solid concentration: 8.1% by mass) had a number average particle size of 30 nm and a glass transition point (Tg) of 102° C.

[Method for Producing Toner T-1]

(pH Adjusting Process)

A 1-L three-necked flask equipped with a thermometer and a stirring impeller was set in a water bath and the flask was charged with 300 g of ion exchanged water. Thereafter, the internal temperature of the flask was maintained at 30° C. using the water bath. Subsequently, a solution of p-toluenesulfonic acid (concentration: 17% by mass) was added to the flask contents to adjust pH of the flask contents to 4.

(Shell Layer Formation Process)

Subsequently, 37 g of a liquid containing hydrophobic resin particles (the suspension A of the hydrophobic resin particles prepared as above) and 1 g of a liquid containing positively chargeable resin particles (the suspension B-1 of the positively chargeable resin particles prepared as above) were added to the flask contents.

Subsequently, 300 g of the toner cores prepared as above and 1 g of sodium 1-decanesulfonate were added to the flask contents and the flask contents were sufficiently stirred. Thereafter, 500 g of ion exchanged water was added to the flask contents. Subsequently, the internal temperature of the flask was increased to 65° C. at a rate of 1° C./min while the flask contents were stirred, and maintained at the temperature (65° C.) for one hour. Formation of a film from the hydrophobic resin particles contained in the suspension A adequately proceeded by maintaining the liquid temperature at a temperature (65° C.) that is 6° C. lower than the glass transition point (71° C.) of the hydrophobic resin particles. The inventor confirmed that formation of a film from the hydrophobic resin particles adequately proceeds in a liquid by maintaining the liquid temperature at a temperature of at least "(the glass transition point of the hydrophobic resin particles)−6° C.". Note that the formation of a film from the hydrophobic resin particles contained in the suspension A proceeds even when the liquid temperature is maintained at a temperature higher than 65° C. However, the production cost can be reduced when the formation of a film from the hydrophobic resin particles is caused to proceed at a low temperature.

The positively chargeable resin particles contained in the suspension B-1 had a higher glass transition point (90° C.) and therefore were kept in the particulate form even after the liquid temperature was maintained at 65° C. for one hour.

Subsequently, sodium hydroxide was added to the flask contents to adjust pH of the flask contents to 7. Then, the flask contents were cooled to normal temperature (approximately 25° C.). As a result, a dispersion containing toner mother particles was prepared.

(Washing Process)

A wet cake of the toner mother particles was collected from the dispersion of the toner mother particles obtained as described above by filtration (solid-liquid separation) using a Buchner funnel. Thereafter, the collected wet cake of the toner mother particles was re-dispersed in ion exchanged water. Further, dispersion and filtration were repeated five times for washing the toner mother particles.

(Drying Process)

Subsequently, the resultant toner mother particles were dispersed in an aqueous solution of ethanol at a concentration of 50% by mass. Through the above, a slurry of the toner mother particles was prepared. Subsequently, the toner mother particles in the slurry was dried using a continuous type surface modifier (Coatmizer (registered Japanese trademark) produced by Freund Corporation) under conditions of a hot air temperature of 45° C. and a blower air flow rate of 2 $m^3$/min. As a result, a powder of the toner mother particles was obtained.

(External Addition Process)

Subsequently, the resultant toner mother particles were subjected to external addition. Specifically, a 10-L FM mixer (produced by Nippon Coke & Engineering Co., Ltd.) was used to mix 100 parts by mass of the toner mother particles and 1 part by mass of dry silica particulates (AEROSIL (registered Japanese trademark) REA 90 produced by Nippon Aerosil Co., Ltd.) for five minutes to cause the external additive (silica particles) to adhere to the surfaces of the toner mother particles. Subsequently, the resultant powder was sifted using a 200 mesh sieve (opening 75 μm) to yield a toner including a large number of toner particles.

[Method for Producing Toner T-2]

The toner T-2 was produced according to the same method as the toner T-1 in all aspects other than that the toner mother particles were washed using a solution of p-toluenesulfonic acid between the shell layer formation process and the washing process (after formation of the shell layers and before washing with water) as described below.

(Washing Process Using p-Toluenesulfonic Acid)

A wet cake of the toner mother particles was collected from the dispersion of the toner mother particles by filtration (solid-liquid separation) using a Buchner funnel after the shell layer formation process described above. Thereafter, the collected wet cake of the toner mother particles was re-dispersed in a solution of p-toluenesulfonic acid (concentration: 8.6% by mass). Further, dispersion and filtration were repeated five times for washing the toner mother particles.

[Method for Producing Toner T-3]

The toner T-3 was produced according to the same method as the toner T-1 in all aspects other than that the suspension B-3 of the positively chargeable resin particles (additive amount: 1 g) was used instead of the suspension B-1 of the positively chargeable resin particles (additive amount: 1 g) as the liquid containing the positively chargeable resin particles in the shell layer formation process.

[Method for Producing Toner T-4]

The toner T-4 was produced according to the same method as the toner T-1 in all aspects other than that the suspension B-4 of the positively chargeable resin particles (additive amount: 1 g) was used instead of the suspension B-1 of the positively chargeable resin particles (additive amount: 1 g) as the liquid containing the positively chargeable resin particles in the shell layer formation process.

[Method for Producing Toner T-5]

The toner T-5 was produced according to the same method as the toner T-2 in all aspects other than that hydrochloric acid was added instead of the solution of p-toluenesulfonic acid to adjust the pH of the flask contents to 4 in the pH adjusting process.

[Method for Producing Toner T-6]

The toner T-6 was produced according to the same method as the toner T-1 in all aspects other than that the suspension B-2 of the positively chargeable resin particles (additive amount: 1 g) was used instead of the suspension B-1 of the positively chargeable resin particles (additive amount: 1 g) as the liquid containing the positively chargeable resin particles in the shell layer formation process.

[Method for Producing Toner T-7]

The toner T-7 was produced according to the same method as the toner T-1 in all aspects other than that the suspension B-5 of the positively chargeable resin particles (additive amount: 1 g) was used instead of the suspension B-1 of the positively chargeable resin particles (additive amount: 1 g) as the liquid containing the positively chargeable resin particles in the shell layer formation process.

[Method for Producing Toner T-8]

The toner T-8 was produced according to the same method as the toner T-1 in all aspects other than that hydrochloric acid was added instead of the solution of p-toluenesulfonic acid to adjust the pH of the flask contents to 4 in the pH adjusting process.

Table 1 indicates measurement results of amounts of the alkyl benzene sulfonic acid compound (ABS contents) contained in the shell layers of the respective toners T-1 to T-8 produced as above. For example, an amount of the alkyl benzene sulfonic acid compound contained in the shell layers of the toner T-1 was 50 ppm relative to a total mass of the toner. A number average particle size of the positively chargeable resin particles included in the shell layers was substantially the same as the size of the particles at the time of addition (the size of the particles contained in the suspension). The amounts of the alkyl benzene sulfonic acid compound were measured by the following method.

<Quantitative Analysis of Alkyl Benzene Sulfonic Acid Compound>

A vessel was charged with 2 g of a sample (toner) and 50 g of methanol and the vessel contents were irradiated with ultrasonic waves for 30 minutes using an ultrasonic treatment device (UT-106 produced by Sharp Corporation, high-frequency output: maximum 100 W, oscillating method: separately-excited oscillation, oscillatory frequency: 37 kHz) in an environment at a temperature of 23° C. and a relative humidity of 50%. Thereafter, the vessel contents were stirred for 48 hours using a magnetic stirrer (RS-1DN produced by AS ONE Corporation) at a rotational speed of 300 rpm.

The vessel contents were subsequently filtrated to yield a filtrate which was a liquid of methanol (methanol solution) in which the alkyl benzene sulfonic acid compound in the sample (toner) was dissolved. The resultant methanol solution was then concentrated using a rotatory evaporator. Liquid chromatography analysis was performed on the resultant concentrate to obtain a chromatogram. The amount of the alkyl benzene sulfonic acid compound (unit: ppm) was determined using a reference material (a sample whose concentration was known) based on an area of a peak characteristic of the alkyl benzene sulfonic acid compound (specifically, p-toluenesulfonic acid) included in the obtained chromatogram. The liquid chromatography was performed under the following conditions.

<Conditions of Liquid Chromatography>

Measuring device: Integrated high performance liquid chromatograph (HPLC) system (LC-2010 produced by Shimadzu Corporation)

Detection wavelength: 207 nm

Column: Shim-pack VP-ODS produced by Shimadzu Corporation (inner diameter: 4.6 mm, length: 15 cm)

Column temperature: 40° C.

Developing solvent: ion exchanged water/acetonitrile ($CH_3CN$)

Flow rate: 1.0 mL/min

Sample injection amount: 10 μL

Note that only ion exchanged water was initially caused to flow as the developing solvent, and when five minutes had passed after initiation of the flow of the ion exchanged water, a mixed liquid of the ion exchanged water and acetonitrile was caused to flow as the developing solvent while a ratio between the ion exchanged water and acetonitrile was varied. Specifically, a ratio of acetonitrile in the developing solvent was gradually increased so that the developing solvent was constituted by only acetonitrile after 25 minutes. The developing solvent constituted by only acetonitrile was caused to flow for additional 10 minutes.

[Evaluation Methods]

Samples (the toners T-1 to T-8) each were evaluated according to the following evaluation methods.

(Charge Decay Characteristic)

A charge decay constant α of a sample (toner) was measured in accordance with Japan Industrial Standard (JIS) C 61340-2-1-2006 using an electrostatic diffusivity measuring device (NS-D100 produced by Nano Seeds Corporation). The following describes a method for evaluating the charge decay constant of the toner.

The sample (toner) was placed into a measurement cell. The measurement cell was a metal cell with a recess having an inner diameter of 10 mm and a depth of 1 mm. The sample was thrust from above using a glass slide to fill the recess of the cell with the sample. A portion of the sample brimming over the cell was removed by reciprocating the glass slide on the surface of the cell. The cell was filled with at least 0.04 g and no greater than 0.06 g of the sample.

Subsequently, the measurement cell filled with the sample (toner) was left for 12 hours in an environment at a temperature of 45° C. and a relative humidity of 90%. Thereafter, the measurement cell was grounded and placed in an electrostatic diffusivity measuring device in an environment at a temperature of 45'C and a relative humidity of 90%. Ions were then supplied to the sample through corona discharge to charge the sample. The probe gap was 1 mm and the charging period was 0.5 seconds. After elapse of 0.7 seconds from completion of corona discharge, the surface potential of the sample was measured continuously under conditions of a sampling frequency of 1 Hz. A charge decay constant (charge decay rate) α was calculated based on the measured surface potential and an equation $V=V_0\exp(-\alpha\sqrt{t})$. In the equation, V represents a surface potential [V], $V_0$ represents an initial surface potential [V], and t represents a decay period [second].

A charge decay constant of no greater than 0.030 was evaluated as G (good), and a charge decay constant of greater than 0.030 was evaluated as B (bad).

(Charge Rise Characteristic)

First, 0.8 g of a sample (toner) and 10 g of a developer carrier (carrier for TASKalfa5550ci produced by KYOCERA Document Solutions Inc.) were mixed for one minute in an environment at a temperature of 23° C. and a relative humidity of 50% using a mixer (TURBULA (registered Japanese trademark) Mixer T2F produced by Willy A. Bachofen (WAB) AG) to obtain a first evaluation developer (two-component developer). Then, a charge amount of the toner in the first evaluation developer (hereinafter referred to as a charge amount $Q_A$) was measured.

Also, 0.8 g of the sample (toner) and 10 g of the developer carrier (carrier for TASKalfa5550ci produced by KYOCERA Document Solutions Inc.) were mixed for 30 minutes in an environment at a temperature of 23° C. and a relative humidity of 50% using the mixer (TURBULA Mixer T2F produced by Willy A. Bachofen (WAB) AG) to obtain a second evaluation developer (two-component developer). Then, a charge amount of the toner in the second evaluation developer (hereinafter referred to as a charge amount $Q_B$) was measured.

The charge amounts $Q_A$ and $Q_B$ were each measured using a Q/m meter (MODEL 210HS-1 produced by TREK, INC.) under the following conditions.

<Method for Measuring Charge Amount of Toner in Developer>

First, 0.10 g of a measurement target (a developer: a toner and a carrier) was supplied to a measurement cell of the Q/m meter, and only the toner in the supplied developer was sucked through a sieve (wire netting) for 10 seconds. The charge amount (unit: μC/g) of the toner in the developer was calculated based on an expression "total electric amount (unit: μC) of sucked toner/mass (unit: g) of sucked toner".

A charge rise constant represented by an equation "charge rise constant=$Q_B/Q_A$" was determined based on the charge amounts $Q_A$ and $Q_B$ measured as above. A charge rise constant of no greater than 1.30 was evaluated as G (good), and a charge rise constant of greater than 1.30 was evaluated as B (bad).

(Low-Temperature Fixability)

First, 100 parts by mass of a developer carrier (carrier for TASKalfa5550ci produced by KYOCERA Document Solutions Inc.) and 10 parts by mass of a sample (toner) were mixed for 30 minutes using a ball mill to obtain an evaluation developer (two-component developer).

A color printer (FS-05250DN produced by KYOCERA Document Solutions Inc.) equipped with a roller-roller type heat and pressure fixing device (nip width: 8 mm) was modified so as to be capable of changing the fixing temperature for use as an evaluation apparatus. The evaluation developer prepared as above was loaded into a developing device of the evaluation apparatus, and the sample (toner for replenishment use) was loaded into a toner container of the evaluation apparatus.

A solid image having a size of 25 mm×25 mm was formed on paper having a basis weight of 90 g/m$^2$ (plain paper of A4 size) using the evaluation apparatus under conditions of a linear speed of 200 mm/s and a toner application amount of 1.0 mg/cm$^2$ in an environment at a temperature of 23° C. and a relative humidity of 50%. Subsequently, the paper having the image formed thereon was passed through the fixing device of the evaluation apparatus.

A lowest fixing temperature was measured within a rage of the fixing temperature from 100° C. to 200° C. Specifically, a lowest temperature (lowest fixing temperature) at which the solid image (toner image) was able to be fixed to the paper was measured while the fixing temperature of the fixing device was increased 5° C. at a time from 100° C. Whether or not toner fixing was accomplished was checked by a fold-rubbing test. Specifically, the fold-rubbing test was performed by folding the paper that had been passed through the fixing device in half such that a surface on which the image was formed was folded inwards, and by rubbing a 1 kg weight covered with cloth back and forth on the image on the fold five times. Then, the paper was unfolded and the folded portion of the paper (portion in which the solid image was formed) was observed. The length of toner peeling (peeling length) in the folded portion was measured. The lowest fixing temperature was determined to be the lowest temperature among fixing temperatures for which the peeling length was no greater than 1 mm. A lowest fixing temperature no higher than 150° C. was evaluated as G (good), and a lowest fixing temperature higher than 150° C. was evaluated as B (bad).

[Evaluation Results]

Table 2 indicates evaluation results (charge decay characteristic: charge decay constant, charge rise characteristic: charge rise constant, and low-temperature fixability: whether lowest fixing temperature is good or bad) for each of the toners T-1 to T-8.

TABLE 2

| | Toner | Charge | | Low-temperature fixability |
|---|---|---|---|---|
| | | Rise characteristic | Decay characteristic | |
| Example 1 | T-1 | 1.21 | 0.021 | G |
| Example 2 | T-2 | 1.19 | 0.025 | G |
| Example 3 | T-3 | 1.23 | 0.023 | G |
| Example 4 | T-4 | 1.22 | 0.023 | G |
| Example 5 | T-5 | 1.26 | 0.029 | G |
| Comparative example 1 | T-6 | 1.42 (B) | 0.021 | G |
| Comparative example 2 | T-7 | 1.55 (B) | 0.020 | G |
| Comparative example 3 | T-8 | 1.59 (B) | 0.020 | G |

The toners T-1 to T-5 (toners according to first through fifth examples) each had the above-described basic features. Specifically, in each of the toners T-1 to T-5, the shell layer included a resin film and a plurality of resin particles that were each more positively chargeable than the resin film. The resin film was more hydrophobic than the resin particles. The shell layer contained the alkyl benzene sulfonic acid compound. The resin particles contained a resin having the specific repeating unit (repeating unit capable of forming a salt with the alkyl benzene sulfonic acid compound). Note that in each of the toners T-1 to T-5, the surface of the shell layer had a sea-like region (specifically, a hydrophobic region) and a plurality of island-like regions (specifically, positively chargeable regions) distributed like islands in the sea-like region. As indicated in Table 2, each of the toners T-1 to T-5 was excellent in the charge decay characteristic, the charge rise characteristic, and the low-temperature fixability.

The toners T-6 and T-7 (toners according to first and second comparative examples) were inferior to the toners T-1 to T-5 in the charge rise characteristic. It is considered that the shell layer did not retain an appropriate amount of the alkyl benzene sulfonic acid compound since 2-vinylthiophene and 9-vinylcarbazole are not capable of forming a salt with the alkyl benzene sulfonic acid compound.

The toner T-8 (toner according to third comparative example) was inferior to the toners T-1 to T-5 in the charge rise characteristic. It is considered that the shell layer did not contain the alkyl benzene sulfonic acid compound since the alkyl benzene sulfonic acid compound was not used in production of the toner T-8.

What is claimed is:

1. An electrostatic latent image developing toner, comprising a plurality of toner particles each including a core and a shell layer covering a surface of the core, wherein the shell layer includes a resin film and a plurality of resin particles, the shell layer contains a first resin forming the resin film, a second resin forming the resin particles, and an alkyl benzene sulfonic acid compound, the first resin is a polymer of monomers including at least one styrene-based monomer and at least one acrylic acid-based monomer, the second resin is a polymer of monomers including at least one acrylic acid-based monomer and at least one monomer selected from the group consisting of pyridine compounds, pyridazine compounds, imidazole compounds, pyrazole compounds, and quaternary ammonium compounds, and the second resin has a repeating unit capable of forming a salt with the alkyl benzene sulfonic acid compound.

2. The electrostatic latent image developing toner according to claim 1, wherein the shell layer contains p-toluenesulfonic acid or a derivative thereof as the alkyl benzene sulfonic acid compound.

3. The electrostatic latent image developing toner according to claim 2, wherein an amount of the alkyl benzene sulfonic acid compound contained in the shell layer is at least 50 ppm and no greater than 4000 ppm relative to a total mass of the electrostatic latent image developing toner.

4. The electrostatic latent image developing toner according to claim 1, wherein the second resin has at least one repeating unit derived from an electron-donating heteroaromatic compound as the repeating unit capable of forming a salt with the alkyl benzene sulfonic acid compound.

5. The electrostatic latent image developing toner according to claim 4, wherein the second resin has at least one repeating unit derived from a pyridine compound, a pyridazine compound, an imidazole compound, or a pyrazole compound, as the repeating unit derived from the electron-donating heteroaromatic compound.

6. The electrostatic latent image developing toner according to claim 1, wherein the second resin has at least one repeating unit derived from a quaternary ammonium compound as the repeating unit capable of forming a salt with the alkyl benzene sulfonic acid compound.

7. The electrostatic latent image developing toner according to claim 1, wherein the alkyl benzene sulfonic acid compound and the repeating unit capable of forming a salt with the alkyl benzene sulfonic acid compound are present in the form of a salt.

8. The electrostatic latent image developing toner according to claim 1, wherein a surface of the shell layer has a sea-like region and a plurality of island-like regions distributed like islands in the sea-like region, the sea-like region is constituted by a portion of the resin film exposed at the surface of the shell layer, and the island-like regions are constituted by portions of the resin particles exposed from the resin film.

9. The electrostatic latent image developing toner according to claim 8, wherein the first resin has a glass transition point of at least 60° C. and no greater than 75° C., the second resin has a glass transition point of at least 80° C. and no greater than 110° C., the core contains a polyester resin having a glass transition point of at least 20° C. and no greater than 55° C., the glass transition point of the first resin is at least 10° C. higher than the glass transition point of the polyester resin, and the glass transition point of the second resin is at least 10° C. higher than the glass transition point of the first resin.

* * * * *